US005820921A

United States Patent [19]

Kawase et al.

[11] Patent Number: 5,820,921

[45] Date of Patent: Oct. 13, 1998

[54] METHOD OF PRODUCING A CATHODE RAY TUBE

[75] Inventors: Saori Kawase, Kanagawa; Nobuyuki Matsushima, Tokyo; Shuichi Saito, Kanagawa, all of Japan

[73] Assignee: Sony Corporation, Tokyo, Japan

[21] Appl. No.: 665,885

[22] Filed: Jun. 19, 1996

[30] Foreign Application Priority Data

Jun. 21, 1995 [JP] Japan ..... 7-154801

[51] Int. Cl.[6] ..... B05D 5/06

[52] U.S. Cl. ..... 427/64; 427/68; 427/236; 427/273; 427/264; 427/265; 427/269; 427/407.1; 427/419.2

[58] Field of Search ..... 427/64, 68, 236, 427/273, 407.1, 264, 265, 269, 419.2

[56] References Cited

U.S. PATENT DOCUMENTS 3,947,608 3/1976 Duinker et al. ..... 427/230

5,178,906 1/1993 Patel et al. ..... 427/64

*Primary Examiner*—Janyce Bell

*Attorney, Agent, or Firm*—Hill & Simpson

[57] ABSTRACT

A phosphor layer is formed on an inside surface of a panel of a glass bulb comprising the panel and funnel connected with each other. A nozzle sprays an organic solvent lacquer on the phosphor layer to form a lacquer intermediate film under conditions of $$a/2 \leqq L \cdot \tan(\Theta/2) \leqq (a/2) + \alpha (0 \leqq \alpha)$$

where, a is the length of the short side of the inside surface of the panel,

L is the length from the connecting portion of the panel and funnel to the nozzle in the direction of spray, $\Theta 0$ is the angle of spray of the nozzle, and $\alpha$ is a length addition parameter. The lacquer intermediate film formed on the inside surface of the funnel is removed by a liquid.

5 Claims, 3 Drawing Sheets

STRUCTURE OF PRECIPITATED PHOSPHOR LAYER ON CRT

STRUCTURE OF PRECIPITATED PHOSPHOR LAYER ON CRT

FLOW CHART OF PRECIPITATION OF PHOSPHOR ON SURFACE

LACQUER SPRAYING ANGLE AND NOZZLE POSITION

METHOD OF PRODUCING A CATHODE RAY TUBE

BACKGROUND OF THE INVENTION

1. Field of the Invention

The present invention relates to a method of producing a cathode ray tube, more particularly relates to an improvement of the process for spraying lacquer to form a lacquer intermediate film on an inner surface of the cathode ray tube.

2. Description of the Related Art

In the related art, cathode ray tubes have glass bulbs comprised of a panel, funnel, and neck. Electrons are emitted from an electron gun to a phosphor layer formed on an inner surface of the panel so as to cause the phosphors to emit light.

Among this type of cathode ray tube, the cathode ray tubes for projection televisions and cathode ray tubes for black and white televisions (monochrome televisions) are for example produced in the following way.

First, the inner surface of the glass bulb on which the phosphor layer is to be formed is cleaned by pure water etc., then an electrolyte aqueous solution such as barium acetate aqueous solution is injected in the bulb, then a suspension of phosphors dispersed in an aqueous solution of water glass serving as the adhesive is poured in and allowed to stand for a predetermined time to allow the phosphors to precipitate. After the phosphors precipitate, the glass bulb is slowly tilted so as to form the phosphor layer.

Next, a continuous, good aluminum vapor deposited film is formed by moistening the phosphor layer by pure water etc., covering the majority of the phosphor layer with a film of water, then spraying an organic solvent lacquer comprised mainly of an acrylic resin to form a very thin lacquer intermediate film on the water film. Next, the lacquer intermediate film from the funnel to the neck, where the phosphor layer is not to be formed, is removed by filling pure water. This is because if a lacquer intermediate film is formed at a region where no phosphor layer is to be provided, the aluminum vapor deposited film formed on that region will swell up during the later baking process and cause peeling from the funnel of the cathode ray tube.

Further, demoisturized air etc. is used to dry the phosphor layer, then a predetermined region is coated and dried with a carbon film. Finally, aluminum is vapor deposited to form an aluminum vapor deposited film, then the organic material used at the time of forming the phosphor layer is heated to 400° to 440° C. to cause it to break down for removal. The phosphor layer is formed through these steps.

In the above method of production of a cathode ray tube, however, in the so-called "lacquer spraying" process for spraying the organic solvent lacquer comprised of the acrylic resin etc. on the phosphor layer, when the nozzle was too close to the inner surface of the panel, the lacquer would not be sprayed over the entire surface of the panel and therefore there would be portions where no lacquer intermediate film was formed. On the other hand, if the nozzle was too far from the panel, the sprayed lacquer would first strike the funnel and splatter back to the panel along with the liquid earlier coated on the funnel to prevent adhesion of the lacquer. The liquid for prevention of adhesion of the lacquer would therefore cause radial unevenness with a high transmittance at the panel.

SUMMARY OF THE INVENTION

The present invention was made in consideration of the above disadvantages in the related art and has as its object the provision of a method of producing a cathode ray tube which prevents the radial unevenness with a high transmittance caused during the process of spraying the lacquer and thereby enables the formation of a lacquer intermediate film having an excellent surface quality and the improvement of the uniformity of the surface.

To achieve the above object, according to the present invention, there is provided a method of producing a cathode ray tube including the steps of: forming a phosphor layer on an inside surface of a panel of a glass bulb comprising the panel and funnel connected with each other, using a nozzle to spray an organic solvent lacquer on the phosphor layer to form a lacquer intermediate film under conditions of $$a/2 \leqq L \cdot \tan(\Theta/2) \leqq (a/2)+\alpha (0 \leqq \alpha)$$

where, a is the length of the short side of the inside surface of the panel,

L is the length from the connecting portion of the glass bulb to the nozzle in the direction of spray, and $\Theta$ is the angle of spray of the nozzle, and $\alpha$ is a length addition parameter, then removing the lacquer intermediate film formed on the inside surface of the funnel by a liquid.

The length addition $\alpha$ is preferably suitably changed in accordance with the size of the panel of the glass bulb. For example, the parameter a may be set to 15 mm when the glass bulb is of a 7 inch size, 30 mm when the glass bulb is of a 14 inch size, and 45 mm when the glass bulb is of a 21 inch size.

Preferably, the nozzle and the glass bulb are rotated relative to each other when spraying the organic solvent lacquer. In this case, it is possible to turn just the nozzle or turn just the glass bulb. Further, it is possible to turn both of the nozzle and the glass bulb. Causing this relative rotation enables the excess lacquer which is sprayed to be shaken off well.

More preferably, the method of producing a cathode ray tube of the present invention is applied to the production of a cathode ray tube having a phosphor layer which is formed by the precipitation method.

According to the present invention, there is also provided a method of forming a fluorescent screen of a cathode ray tube having a glass bulb, including the steps of: cleaning an inner surface of a panel portion of the glass bulb on which a phosphor layer is to be formed; injecting an electrolyte aqueous solution into said glass bulb; depositing a suspension of phosphor dispersed in an aqueous solution of water glass on said inner surface of said panel portion; drying said suspension to form a phosphor layer; coating said phosphor layer with cover water; coating a liquid for preventing adhesion of lacquer on said inner surface; spraying an organic solvent lacquer on said inner surface to form a lacquer intermediate film on the water film; trimming said lacquer intermediate film where said phosphor layer is not formed; drying said phosphor layer; coating electro conductive carbon on said phosphor layer to form a carbon film; forming a conductive metal layer on said lacquer film; and heating said glass bulb to remove said lacquer film. The spraying for forming the lacquer intermediate film being carried out under conditions of $$a/2 \leqq L \cdot \tan(\Theta/2) \leqq (a/2)+\alpha (0 \leqq \alpha)$$

where, a is the length of the short side of the inside surface of the panel, L is the length from the connecting portion of the glass bulb to the nozzle in the direction of spray, Θ is the angle of spray of the nozzle, and α is a length addition parameter.

BRIEF DESCRIPTION OF THE DRAWINGS

These and other objects and features of the present invention will become clearer from the following description of the preferred embodiments given with reference to the accompanying drawings, in which.

DETAILED DESCRIPTION OF THE PREFERRED EMBODIMENTS

Below, the present invention will be explained using an embodiment with reference to the drawings.

Figure 1:
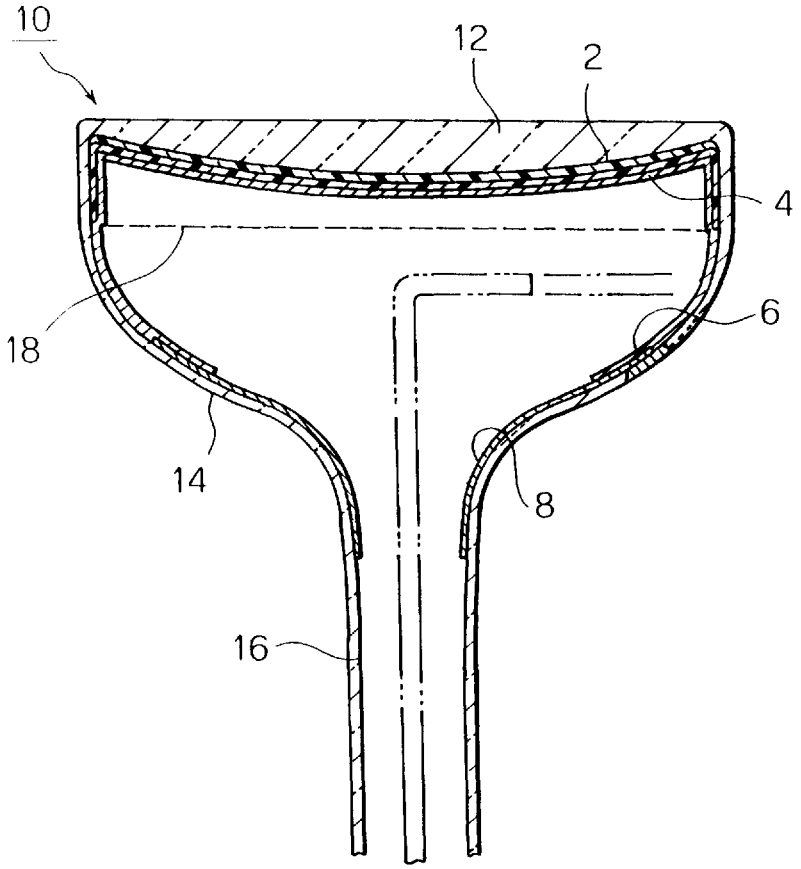
FIG. 1 is a cross-sectional view of a cathode ray tube according to an embodiment of the present invention.

The cathode ray tube used in the present embodiment is one used for a projection television or a black and white television. As shown in FIG. 1, a cathode ray tube has a glass bulb 10 comprised of a panel 12, funnel 14, and neck 16. Electrons are emitted from an electron gun (not shown) to a phosphor layer 2 formed on the inner surface of the panel 12 so as to cause the phosphors included in the phosphor layer 2 to emit light.

On the inner surface of the panel 12, the above-mentioned phosphor layer 2 which contains the phosphors is formed. On the surface of the phosphor layer 2, a lacquer intermediate film 4 is formed. The lacquer intermediate film 4 is comprised organic solvent lacquer comprising mainly acrylic resin and dissolved in organic solvent such as a toluene, ethyl acetate. By interposing a very thin lacquer intermediate film 4 between the phosphor layer 2 and the aluminum vapor deposited film 6, it is possible to obtain a continuous, good aluminum vapor deposited film 6. This lacquer intermediate film 4 is formed up to the connecting portion of the panel 12 and the funnel 14 so as to cover at least the phosphor layer 2.

A conductive carbon film 8 is formed at predetermined regions on the inner surface of the funnel 14. Further, an aluminum vapor deposited film 6 is formed on the inner surface of the panel 12 and the funnel 14 with the objective of preventing ion burning of the phosphors by the electron beam and increasing the light emitting efficiency.

Figure 2:
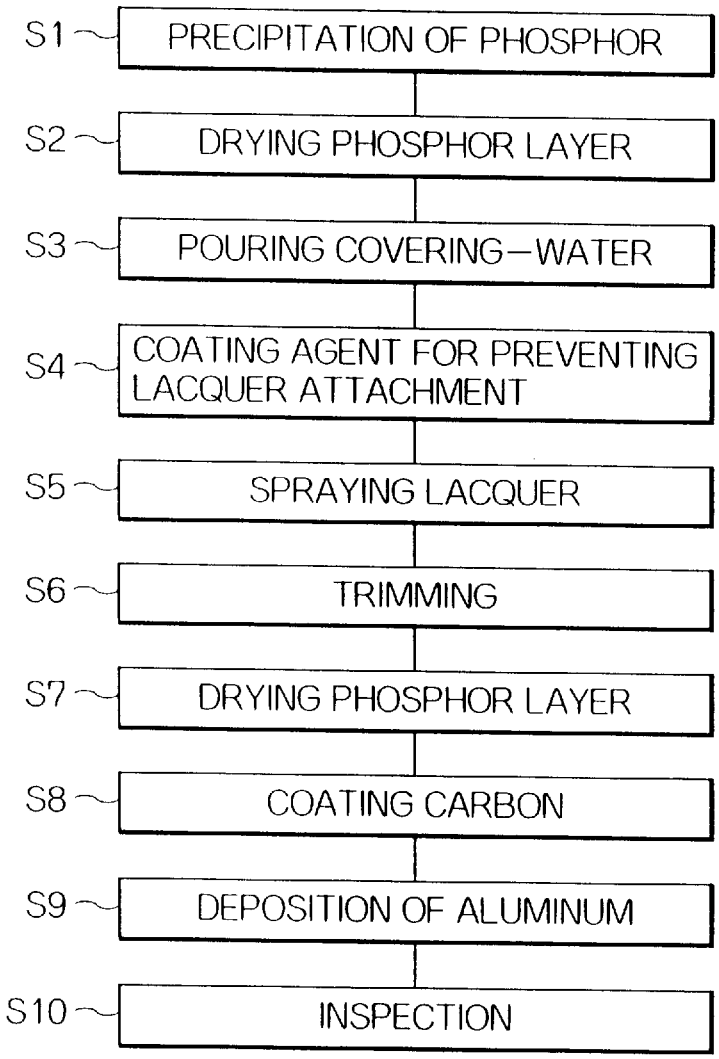
FIG. 2 is a flow chart of a method of producing a cathode ray tube according to an embodiment of the present invention.

Next, the method of producing a cathode ray tube according to this embodiment will be explained with reference to FIG. 2.

First, the inner surface of the glass bulb 10 on which the phosphor layer 2 is to be formed is cleaned using an aqueous solution of hydrogen fluoride, an aqueous solution of nitric acid, and pure water. Next, the panel 12 of the glass bulb 10 is turned downward and a predetermined amount of an aqueous solution of barium acetate or other aqueous solution of an electrolyte is poured in the glass bulb 10. Then, a suspension of predetermined phosphors dispersed in an aqueous solution of water glass serving as the adhesive is poured in and allowed to stand for a predetermined time to allow the phosphors to precipitate (step 1:S1). After the phosphors precipitate, the glass bulb is slowly tilted so as to form the phosphor layer 2. In this case, the phosphor layer 2 is dried by vacuum drying etc. (step 2:S2).

A continuous, good aluminum vapor deposited film 6 is formed by moistening the phosphor layer 2 by pure water (covering water) etc. and covering the majority of the phosphor layer 2 with a film of water (step 3:S3), then coating a liquid (an agent) for preventing adhesion of the lacquer on the inner surface of the funnel 14 below the connecting portion 18 of the panel 12 and funnel 14 and on the neck 16 (step 4:S4).

Figure 3:
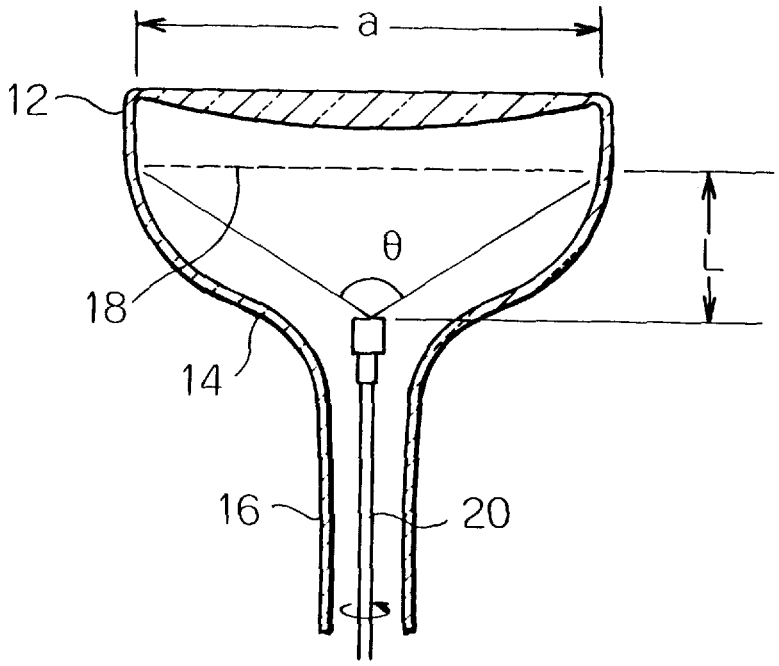
FIG. 3 is a cross-sectional view of a cathode ray tube showing the step of spraying lacquer according to an embodiment of the present invention.

As shown in FIG. 3, the panel 12 of the glass bulb 10 is turned upward and an organic solvent lacquer comprised mainly of an acrylic resin is sprayed on the inner surface of the panel 12 and the funnel 14 using a nozzle 20 (step 5:S5), while rotating the glass bulb 10, to form a very thin lacquer intermediate film 4 on the water film. At this time, in this embodiment, the organic solvent lacquer is sprayed under spraying conditions satisfying $$a/2 \leqq L \cdot \tan(\Theta/2) \leqq (a/2)+\alpha (0 \leqq \alpha)$$

where, a is the length of the short side of the inside surface of the panel,

L is the length from the connecting portion of the glass bulb to the nozzle in the direction of spray, Θ is the angle of spray of the nozzle, and α is a length addition parameter.

That is, the organic solvent lacquer is sprayed from the nozzle 20 in a pattern of a width equal to the length of the short side a of the inner surface of the panel 12 or that length addition parameter a. Here, the value of the parameter a is preferably suitably changed in accordance with the size of the panel of the glass bulb. For example, it may be set to 15 mm when the glass bulb is of a 7 inch size, 30 mm when the glass bulb is of a 14 inch size, and 45 mm when the glass bulb is of a 21 inch size. By defining the parameter a this value, the edge of the pattern of the lacquer sprayed from the nozzle 20 becomes positioned at exactly the connecting portion 18 of the panel 12 and the funnel 14 and therefore the liquid for preventing adhesion of the lacquer, coated below the connecting portion 18, is not caught up and splashed to the panel, while sufficient lacquer is sprayed to the panel 12. Therefore, there is no formation of an area with no lacquer intermediate film 4.

If the lacquer intermediate film 4 is formed on a region where the phosphor layer 2 is not formed, the aluminum vapor deposited film 6 vapor-deposited on that region will blister by the subsequent baking process and peeling will occur from the funnel 14 of the cathode ray tube, so as shown by the two-dot-dash line in FIG. 1, the lacquer intermediate film 4 from the funnel 14 to the neck 16, where the phosphor layer 2 is not formed, is removed by spraying pure water (trimming step:step 6:S6).

Demoisturized air etc. is used to dry the phosphor layer 2 (step 7:S7), then a predetermined region of the inner surface of the glass bulb 10 is coated and dried with electroconductive carbon to form a carbon film 8 (step 8:S8).

Aluminum is vapor deposited to form an aluminum vapor deposited film 6 (step 9:S9), then the organic material used when forming the phosphor layer 2 is heated to 400° to 440° C. to decompose and remove it.

Finally, an inspection is carried out (step 10:S10).

As explained above, according to the present invention, since the organic solvent lacquer is sprayed from the nozzle in a pattern of a width equal to the length of the short side of the inner surface of the panel or that length addition parameter α, the lacquer is sprayed over the entire surface of the panel, but no unnecessary lacquer is sprayed to the funnel. Accordingly, it is possible to prevent the formation of areas in the panel where no lacquer intermediate film is formed due to insufficient spraying and also possible to suppress unevenness of the panel due to the detrimental effects of the liquid for preventing adhesion of the lacquer arising as a result of the unnecessary spraying of lacquer at the funnel.

Note that the present invention is not limited to the above embodiments and includes modifications within the scope of the claims.

What is claimed is:

1. A method of producing a cathode ray tube including the steps of:

forming a phosphor layer on an inside surface of a panel of a glass bulb wherein said glass bulb includes a funnel portion connected to said panel so as to form a connecting portion therebetween;

spraying, with a nozzle positioned within said glass bulb, an organic solvent lacquer on said phosphor layer to form a lacquer intermediate film under conditions of $$a/2 \leqq L \cdot \tan(\Theta/2) \leqq (a/2) + \alpha (0 \leqq \alpha)$$

where, a is a length of a short side of said inside surface of said panel,

L is a length from said connecting portion of said glass bulb to said nozzle in direction of spray, Θ is an angle of spray of said organic solvent lacquer from said nozzle, and α is a length addition parameter corresponding to an overall size of said panel; and removing, with a liquid, any of said lacquer intermediate film unintentionally formed on an inside surface of said funnel during said step of spraying.

2. A method of producing a cathode ray tube as set forth in claim 1, wherein said nozzle and said glass bulb are rotated relative to each other when spraying said organic solvent lacquer.

3. A method of producing a cathode ray tube as set forth in claim 2, wherein said phosphor layer is formed by a precipitation process.

4. A method of producing a cathode ray tube as set forth in claim 1, wherein said phosphor layer is formed by a precipitation process.

5. A method of forming a fluorescent screen of a cathode ray tube having a glass bulb wherein said glass bulb includes a funnel portion connected to a panel portion so as to form a connecting portion therebetween, including the steps of:

cleaning an inner surface of said panel portion of the glass bulb on which a phosphor layer is to be formed;

injecting an electrolyte aqueous solution into said glass bulb;

depositing a suspension of phosphor dispersed in an aqueous solution of water glass on said inner surface of said panel portion;

drying said suspension to form a phosphor layer;

moistening said phosphor layer with cover water;

covering said phosphor layer with a water film;

coating a liquid for preventing adhesion of lacquer on an inner surface of said funnel portion;

spraying, with a nozzle positioned within said glass bulb, an organic solvent lacquer on said inner surface of said panel portion to form a lacquer intermediate film on said water film;

trimming said lacquer intermediate film where said phosphor layer is not formed;

drying said phosphor layer;

coating electro conductive carbon on a predetermined region of an inner surface of said glass bulb to form a carbon film;

forming a conductive metal layer on said lacquer intermediate film; and heating said glass bulb to remove said lacquer intermediate film;

said step of spraying an organic solvent lacquer being carried out under conditions of $$a/2 \leqq L \cdot \tan(\Theta/2) \leqq (a/2) + \alpha (0 \leqq \alpha)$$

where, a is a length of a short side of said inside surface of said panel,

L is a length from said connecting portion of said glass bulb to said nozzle in a direction of spray, Θ is an angle of spray of said organic solvent lacquer from said nozzle, and α is a length addition parameter corresponding to an overall size of said panel.

* * * * *